United States Patent [19]

Marechal

[11] 4,147,568

[45] Apr. 3, 1979

[54] COPPER-ZINC-NICKEL-MANGANESE ALLOYS

[75] Inventor: Pierre Marechal, Waldenburg, Switzerland

[73] Assignee: Institut Straumann AG, Switzerland

[21] Appl. No.: 816,175

[22] Filed: Jul. 15, 1977

[30] Foreign Application Priority Data

Jul. 15, 1976 [CH] Switzerland ..... 9081/76

[51] Int. Cl.[2] ..... C22C 9/04

[52] U.S. Cl. ..... 148/32.5; 58/1 R; 75/134 B; 75/134 C; 148/158

[58] Field of Search ..... 75/134 C, 134 B, 157.5, 75/157; 148/32, 32.5, 158, 160; 58/1 R

[56] References Cited

FOREIGN PATENT DOCUMENTS 897484 3/1945 France ..... 75/157.5

*Primary Examiner*—R. Dean

*Attorney, Agent, or Firm*—McGlew and Tuttle

[57] ABSTRACT

A tetragonal age-hardened copper-zinc-nickel-manganese alloy, which has good cold-working properties which enable it readily to be rolled, drawn and forged, is disclosed. The alloy, which can be used to stamp complicated parts such as escapement forks and pinions for clock work mechanisms, comprises

- 36 to 44% copper,
- 21 to 28% in toto of zinc with or without tin and/or indium, provided that tin and/or indium if present amount together to at most 10%,
- 18 to 25% in toto of nickel with or without cobalt, provided that cobalt if present amounts to at most 5%,
- 10 to 18% manganese,
- up to 0.5% of at least one of beryllium and the rare-earth metals, provided that neither the beryllium content nor the rare-earth metals content exceeds 0.3%, additives from the group lithium, magnesium, calcium and titanium, serving as de-oxidizing elements, and iron as the usual impurity.

15 Claims, 6 Drawing Figures

COPPER-ZINC-NICKEL-MANGANESE ALLOYS

BACKGROUND OF THE INVENTION 1. Field

The present invention relates to a copper tetragonal age-hardened-zinc-nickel-manganese alloy. 2. Prior Art Nickel silver (known as Neusilber in German, maillschort blanc argent in French, and alpacca or alpaca in Italian and Spanish) is understood to mean a Ni-Cu-Zn-alloy, which has a silver-like colour, good corrosion resistance and good strength properties, and which is used as a construction or manufacturing material in mechanical engineering, electrical engineering, architecture as well as for the manufacture of jewelry and articles of craftsmanship.

Known nickel silver alloys may, for example, contain:

45–70%, preferably 60–64%, Cu (for example 62%)
8–45%, preferably 15–24%, Zn (for example 20%) and
8–28%, preferably 12–25%, Ni (for example 18%).

Nickel silver alloys having an Mn additive are also known. They also contain, for example:

1–15%, preferably 2–6%, Mn (for example 4%).

In general, these known nickel silver alloys are in general not capable of being hardened by heat treatment, but are cold-formed in order to obtain an increase in strength, since the ductility is considerably reduced. They do indeed have a white color, but this tends towards being yellowish.

OBJECTS OF THE INVENTION

It is an object of the present invention to produce a tetragonal age-hardened alloy of copper-zinc-nickel-manganese.

It is another object of the present invention to make such an alloy which is capable of being strengthened by cold working to a higher strength than known nickel silver alloys with retention of a high ductility.

It is a further object of the invention to make such an alloy which can be soft soldered, hard soldered and even welded.

SUMMARY OF THE INVENTION

According to the present invention there is provided a tetragonal age-hardened copper-zinc-nickel-manganese alloy comprising:

36 to 44% copper,
21 to 28% in toto of zinc with or without tin and/or indium, provided that tin and/or indium if present amount together to at most 10%,
18 to 25% in toto of nickel with or without cobalt, provided that cobalt if present amounts to at most 5%,
10 to 18% manganese,
up to 0.5% of at least one of beryllium and the rare-earth metals, provided that neither the beryllium content nor the rare-earth metals content exceeds 0.3%, additives from the group lithium, magnesium, calcium and titanium, serving as de-oxidising elements, and iron as the usual impurity. The balance, if any, of the alloy may comprise usual commercial impurities.

Such an alloy is similar to nickel silver, but may be capable of being strengthened by cold-working to a higher strength than the known nickel silver alloys with retention of a high ductility, and may also be hardened by a heat treatment, by means of which strength values may be obtained which are at least equal to those of known nickel silver alloys and of Cu-Be alloys which are especially useful used especially in electrical engineering. The strength of the alloy according to the invention may in fact, in the thermally hardened condition, be greater than the strength of the two known materials referred to and may have a beautiful white color, not tending towards yellowish. It is also capable of being economically manufactured and should be at least equal, in respect of its other qualities, to the known nickel silver alloys and the Cu-Be alloys. The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

BRIEF DESCRIPTION OF THE DRAWINGS

In the drawings:

Referring to the drawings,
FIG. 1 shows a watch housing 10,
FIG. 2 a spur gear 12,
FIG. 3 an escapement fork 14,
FIG. 4 an axle 16,
FIG. 5 a spring 18, and
FIG. 6 a set of electrical contacts 20 all constructed of an alloy of the invention.

Figure 1:
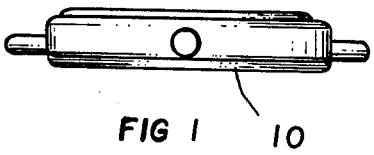
FIGS. 1 to 6 are side elevational views of receiver components of a watch made of an alloy in accordance with the invention.
Figure 2:
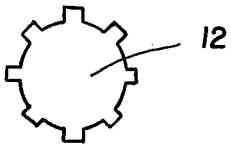
Figure 3:
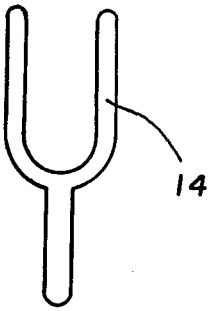
Figure 4:
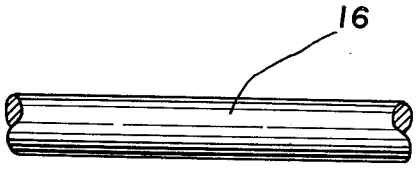
Figure 5:
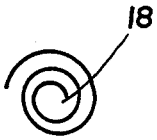
Figure 6:
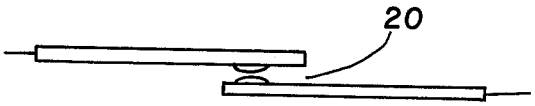

It is to be understood that various modifications may be made to the above-described invention without departing from the spirit and scope thereof as set forth in the following claims.

DESCRIPTION OF THE INVENTION

In a preferred embodiment, the principal constituents of the alloy are present in the following respective proportions:

38 to 42% copper,
23 to 26.5% in toto of zinc with or without tin and/or indium,
19.5 to 22.5% in toto of nickel with or without cobalt,
12 to 16% manganese, and
0.05 to 0.4% of at least one of beryllium and the rare-earth metals.

In an especially preferred embodiment, the principal constituents are as follows:

24.8% in toto of zinc, with or without tin and/or indium,
21% in toto of nickel with or without cobalt,
14% manganese, and
0.2% of at least one of the beryllium and the rare-earth metals, the balance other than the additives and the iron being copper.

The melting range of this new alloy lies between 850° and 960° C., that is 150°-200° below, for example, the melting range of the known Cu Ni 18 Zn 20 nickel silver alloy.

Melting and casting are thereby considerably simplified, since the following advantages can be achieved: energy is saved, smaller losses of Zn and Mn occur, the desired theoretical composition is more readily maintained, and the melting crucible, ingot moulds and other auxiliary equipment have longer working lives. The alloy may, for example, be melted in air with a charcoal blanket or with borax or cryolite slag, and the hardening and de-oxidising additives, as, for instance, Be and the rare-earths, should not be added to the alloy until immediately before casting. The alloy can be hot-worked in the temperature range 600° to 730° C., preferably by extrusion at 670°–710° C. or by rolling and forging at 630°–670° C. The new alloy is easy to hot-work, and large reductions in cross-section, for example in a ratio of 40:1, can be obtained by hot extrusion. The relatively low hot-working temperature enables the hot-working tools to have a long life. All these advantages result in good economy in the hot-working processes.

The alloy is single-phase above about 550° C., and exhibits the so-called $\alpha$phase. Below about 550° C., a tetragonal phase precipitates only slowly in the hot-worked condition and, if the alloy contains Be, an intermetallic phase also precipitates. Since the rates of precipitation of both phases are small, the rate of cooling from the hot-working temperature down to ambient temperature before cold-working is not at all critical, so that at ambient temperature the alloy is still single-phase and can be cold-worked without problems. Reductions in cross-section of up to 95% can be obtained with hot-extruded rods of 16 and 25 mm diameter, which have cooled in air from 690° C. to ambient temperature. A cold-working cross-section reduction of 90% can be obtained by rolling, swaging, drawing, forging and other processes, since the alloy is soft in the annealed condition, possessing a Vickers hardness of only 110 kp $mm^{-2}$. The strength improvement obtained by cold-working is greater than with the known ternary or quaternary nickel silver alloys, but nevertheless the new alloy exhibits a smaller reduction in ductility during cold-working, so that the risk of breakage as a result of over-stressing the material during working is practically excluded. This results in considerably improved economy by comparison with the known ternary and quaternary nickel silver alloys and considerably simplifies, or indeed makes possible for the first time, the production of complicated sections and components.

The result also is that fewer intermediate annealings or recrystallisation annealings are necessary. The recrystallisation annealings can be carried out between 570° and 630° C., preferably at 600° C.

Since the alloy cannot be embrittled by hydrogen, thermal treatments of all types, for example recrystallisation annealing and hardening, can be carried out in pure hydrogen gas or in an atmosphere containing hydrogen gas.

EXAMPLES OF THE INVENTION

The invention will now be more particularly described by way of the following examples.

EXAMPLE 1

With workpieces of an alloy which contains
40% Cu,
24.8% Zn,
20% Ni,
15% Mn,
0.10% Be, and
0.10% rare earths,
and which has been annealed at 600° C. and then cold-rolled to a round section, the following values for the Vickers hardness were obtained:
annealed 110 kp $mm^{-2}$
20% cold-worked 200 kp $mm^{-2}$
30% cold-worked 215 kp $mm^{-2}$
40% cold-worked 230 kp $mm^{-2}$
50% cold-worked 240 kp $mm^{-2}$
75% cold-worked 250 kp $mm^{-2}$
90% cold-worked 270 kp $mm^{-2}$.

Since experience shows that for these alloys the ratio between hardness and strength is 2.1–2.3, tensile strengths of up to 1300 N $mm^{-2}$ can be obtained by cold-working.

If this cold-worked alloy is heat treated between 300° and 450° C., the optimum being between 370° and 420° C., a considerable increase in strength up to 1,750 N $mm^{-2}$ can be observed.

After 30–90% cold-working followed by hardening at 390° C., the following further mechanical properties could be observed:

Uniform Elongation:
1–4%, depending upon strength, namely
1.5–2.5% at 1,750 N $mm^{-2}$
3–4% at 1,500 N $mm^{-2}$ Elongation:
3–6% at 1,750 N $mm^{-2}$
5–8% at 1,500 N $mm^{-2}$.

It can be observed that the annealing time for obtaining the maximum achievable tensile strength varies according to the degree of cold-working of the starting material. The following times were established at 390° C.:
30% cold-worked — 13 hours at 390° C.
60% cold-worked — 9 hours at 390° C.
90% cold-worked — 1.5 hours at 390° C.

Experience shows that from about 20–30% cold-working upwards, the maximum achievable tensile strength is no longer dependent upon the degree of cold-working of the starting material. Without cold-working, a strength of up to 1,300 to 1,600 (maximum) N $mm^{-2}$ can be obtained.

The properties of the new alloy may be considerably better than the corresponding properties of the known ternary or quaternary nickel silver alloys and of the known hardening Cu-Be alloys. Thus, for example, non-hardening ternary nickel silver alloy containing 62% Cu, 18% ni and 20% Zn, which is preferably used as a spring material, possesses in the cold-worked condition a strength of only 610 N $mm^{-2}$ and a elongation of only 1%. A hardening Cu-Be alloy having the composition 1.8–2.1% Be, Co + Ni + Fe 0.2–0.6%, balance Cu, which is also preferably used as a spring material, possesses in the fully hardened condition a strength of only 1,500 N $mm^{-2}$ and an elongation of only 1%.

The very high strength obtained by hardening the cold-worked new alloy is caused by the precipitation below 550° C. of the afore-mentioned tetragonal phase and, if the new alloy contains Be, also by the precipitation of the afore-mentioned intermetallic phase.

In hardened work-pieces of the alloy according to this invention, the high strength is retained up to temperatures of 200°–250° C., whereas in workpieces, for example springs, of the CuNi 18 Zn 20 nickel silver alloy, the strength decreases, after relatively brief heating to 250° C., by 7–15% of the initial strength.

The new alloy possesses the following physical characteristics, the corresponding values for the known alloy CuNi 18 Zn 20 being stated in brackets:

Electrical conductivity:

annealed: $2.7–2.9 \cdot 10^6 \Omega^{-1} m^{-1}$ ($3–3.5 \cdot 10^6 \Omega^{-1} m^{-1}$)
30–90% cold-worked: $2.4–2.7 \cdot 10^6 \Omega^{-1} m^{-1}$ hardened: 30–90 cold-worked, annealed at 390° C.: $2.7–2.9 \cdot 10^6 \Omega^{-1} m^{-1}$.

The electrical conductivity can be increased by about 50% by "over aging".

Modulus of elasticity:

annealed and cold-worked:
approx. $1.1 \cdot 10^5$ N $mm^{-2}$ ($1.25–1.35 \cdot 10^5$ N $mm^{-2}$)
hardened, 30–90% cold-worked, annealed at 390° C.:
approx. $1.2–1.3 \cdot 10^5$ N $mm^{-2}$.

Magnetism: non-magnetic

Density: 8.08 kg/$dm^3$, (8.7 kg/$dm^3$)

EXAMPLE 2

In workpieces of a modified alloy, namely an alloy in which a portion of the Ni content has been replaced by Co and which possesses the following composition:

40% Cu,
24.8% Zn,
20% Ni,
1% Co,
14% Mn,
0.10% Be, and
0.10% rare-earths, tensile strengths of 1 850 N $mm^{-2}$ and higher have been measured, with the same mechanical and thermal treatment.

EXAMPLE 3

In workpieces of an alloy having the composition
23.8% Zn,
2% Sn,
20% Ni,
1% Co,
14% Mn,
0.05% Be,
0.05% rare-earths, and
a balance of Cu
similar values were measured.

The resistance to tarnishing of the new alloy in air is clearly better than that of the previously known ternary and quaternary nickel silver alloys and that of the already known Cu-Be alloys.

Tarnishing in 3% sodium chloride solution at approximately 40° C. is only slight, by comparison with tarnishing of the already known alloys referred to.

In saturated ammonia vapour, the new alloy is not susceptible to stress corrosion.

A surface treatment by plating (chromium plating, nickel plating, silver plating, gold plating) is not necessary for many applications, since both the resistance to tarnishing and the natural colour require no such treatments.

The new alloy can be soft-soldered, hard soldered or even welded. Brief working temperatures below 350°–400° C. do not lead to any loss of strength of the cold-worked or hardened components.

Since the strength and spring properties of the new alloy are 1.8–3 times higher than the corresponding properties of the known nickel silver alloys in general and of the Cu Ni 18 Zn 20 nickel silver alloy, which is preferably used as spring material, and approximately 1.2–1.3 times higher than those of the corresponding Cu-Be alloys, which are also preferably used as spring materials, the new alloy can be very satisfactorily used for the manufacture of springs of all types and also for the production of electrical contact components.

On account of its excellent cold-working properties, the alloy is of special importance for manufacture, for example by rolling, drawing, deep-drawing and forging, of complicated sections or components, which can be subsequently hardened. Since the ductility of the new alloy is relatively high, it is suitable for the stamping of complicated parts which can still be hardened after final machining, for example, blanks for safety keys, clock casings or escapement forks and pinions for watches and clockwork mechanisms. The high strength and ductility of the new alloy in the fully hardened condition make it particularly suitable for many components of clocks or watches which must be wear-resistant and non-magnetic, for example shafts, balance-wheel axles, driving-spring casings, clock and watch casings, and for many components in other precision mechanisms and equipment.

I claim:

1. A tetragonal age-hardened copper-zinc-nickel manganese alloy consisting essentially of
36 to 44% copper,
21 to 28% in toto of zinc with or without tin and/or indium, provided that tin and/or indium if present amount together to at most 10%,
18 to 25% in toto of nickel with or without cobalt, provided that cobalt if present amounts to at most 5%,
10 to 18% managese,
up to 0.5% of at least one of beryllium and the rare-earth metals, provided that neither the beryllium content nor the rare-earth metal content exceeds 0.3%,
additives from the group lithium, magnesium, calcium and titanium, serving as de-oxidizing elements, and iron as the usual impurity.

2. A watch component composed of a tetragonal age-hardened alloy consisting essentially of:
36 to 44% copper,
21 to 28% in toto of zinc with or without and/or indium, provided that tin and/or indium if present amount together to at most 10%,
18 to 25% in toto of nickel with or without cobalt, provided that cobalt if present amounts to at most 5%,
10 to 18% manganese
up to 0.5% of at least one of beryllium and the rare-earth metals, provided that neither the beryllium content nor the rare-earth metals content exceeds 0.3%,
additives from the group lithium, magnesium, calcium and titanium, serving as deoxidizing elements, and iron as the usual impurity.

3. A spring composed of a tetragonal age-hardened alloy consisting essentially of:
36 to 44% copper,
21 to 28% in toto of zinc with or without tin and/or indium, provided that tin and/or indium if present amount together to at most 10%,
18 to 25% in toto of nickel with or without cobalt, provided that cobalt if present amounts to at most 5%,
10 to 18% manganese,
up to 0.5% of at least one of beryllium and the rare-earth metals, provided that neither the beryllium content nor the rare-earth metals content exceeds 0.3%, additives from the group lithium, magnesium, calcium and titanium, serving as de-oxidizing elements, and iron as the usual impurity.

4. An electric contact part composed of a tetragonal age-hardened alloy consisting essentially of 36 to 44% copper, 21 to 28% in toto of zinc with or without tin and/or indium, provided that tin and/or indium if present amount together to at most 10%, 18 to 25% in toto of nickel with or without cobalt, provided that cobalt if present amounts to at most 5%, 10 to 18% manganese, up to 0.5% of at least one of beryllium and the rare-earth metals, provided that neither the beryllium content nor the rare-earth metals content exceeds 0.3%, additives from the group lithium, magnesium, calcium and titanium, serving as de-oxidizing elements, and iron as the usual impurity.

5. A watch component comprising a tetragonal age-hardened alloy consisting essentially of:

38 to 42% copper, 23 to 26.5% in toto of zinc with or without tin and/or indium, 19.5 to 22.5% in toto of nickel with or without cobalt, 12 to 16% manganese, and 0.05 to 0.4% of at least one of beryllium and the rare-earth metals.

6. A spring composed of a tetragonal age-hardened alloy consisting essentially of:

38 to 42% copper, 23 to 26.5% in toto of zinc with or without tin and/or indium, 19.5 to 22.5% in toto of nickel with or without cobalt, 12 to 16% manganese, and 0.05 to 0.4% of at least one of beryllium and the rare-earth metals.

7. A electric contact part, comprising a tetragonal age-hardened alloy consisting essentially of 38 to 42% copper, 23 to 26.5% in toto of zinc with or within tin and/or indium, 19.5 to 22.5% in toto of nickel with or without cobalt, 12 to 16% manganese, and 0.05 to 0.4% of at least one of beryllium and the rare-earth metals.

8. A watch component comprising a tetragonal age-hardened alloy consisting essentially of 24.8% in toto of zinc, with or without tin and/or indium, 21% in toto of nickel with or without cobalt, 14% manganese, and 0.2% of at least one of the beryllium and the rare-earth metals the balance other than the additives and the iron being copper.

9. A spring composed of a tetragonal age-hardened alloy consisting essentially of:

24.8% in toto of zinc, with or without tin and/or indium,

21% in toto of nickel with or without cobalt,

14% manganese, and 0.2% of at least one of the beryllium and the rare-earth metals, the balance other than the additives and the iron being copper.

10. An electric contact part comprising a tetragonal age-hardened alloy consisting essentialy of:

24.8% in toto of zinc, with or without tin and/or indium,

21% in toto of nickel with or without cobalt,

14% manganese, and 0.2% of at least one of the beryllium and the rare-earth metals, the balance other than the additives and the iron being copper.

11. An alloy as claimed in claim 1, consisting essentially of 38 to 42% copper, 23 to 26.5% in toto of zinc with or without tin and/or indium, 19.5 to 22.5% in toto of nickel with or without cobalt, 12 to 16% manganese, and 0.05 to 0.4% of at least one of beryllium and the rare-earth metals.

12. An alloy as claimed in claim 11, consisting essentially of 24.8% in toto of zinc, with or without tin and/or indium, 21% in toto of nickel with or without cobalt, 14% manganese, and 0.2% of at least one of the beryllium and the rare-earth metals, the balance other than the additives and the iron being copper.

13. A watch housing manufactured of a tetragonal age-hardened alloy consisting essentially of 36 to 44% copper, 21 to 28% in toto of zinc with or without tin and/or indium, provided that tin and/or indium if present amount together to at most 10%, 18 to 25% in toto of nickel with or without cobalt, provided that cobalt if present amounts to at most 5%, 10 to 18% manganese, up to 0.5% of at least one of beryllium and the rare-earth metals, provided that neither the beryllium content nor the rare-earth metals content exceeds 0.3%, additives from the group lithium, magnesium, calcium and titanium, serving as de-oxidizing elements, and iron as the usual impurity.

14. A watch spur wheel manufactured of a tetragonal age-hardened alloy consisting essentially of 36 to 44% copper, 21 to 28% in toto of zinc with or without tin and/or indium, provided that tin and/or indium if present amount together to at most 10%, 18 to 25% in toto of nickel with or without cobalt, provided that cobalt if present amounts to at most 5%, 10 to 18% manganese, up to 0.5% of at least one of beryllium and the rare-earth metals, provided that neither the beryllium content nor the rare-earth metals content exceeds 0.3%, additives from the group lithium, magnesium, calcium and titanium, serving as de-oxidizing elements, and iron as the usual impurity.

15. A watch escapement fork manufactured of a tetragonal age-hardened alloy consisting essentially of 36 to 44% copper 21 to 28% in toto of zinc with or without tin and/or indium, provided that tin and/or indium if present amount together to at most 10%, 18 to 25% in toto of nickel with or without cobalt, provided that cobalt if present amounts to at most 5%, 10 to 18% manganese, up to 0.5% of at least one of beryllium and the rare-earth metals, provided that neither the beryllium content nor the rare-earth metals content exceeds 0.3%, additives from the group lithium, magnesium, calcium and titanium, serving as de-oxidizing elements, and iron as the usual impurity.

* * * * *